US005088302A

United States Patent [19]

Tomizawa et al.

[11] Patent Number: 5,088,302

[45] Date of Patent: Feb. 18, 1992

[54] PORTABLE COOLER USING CHEMICAL REACTION

[75] Inventors: Takeshi Tomizawa, Ikoma; Koji Arita, Osaka, both of Japan

[73] Assignee: Matsushita Electric Industrial Co., Ltd., Osaka, Japan

[21] Appl. No.: 683,728

[22] Filed: Apr. 11, 1991

[30] Foreign Application Priority Data

Apr. 12, 1990 [JP] Japan ..... 2-97113

[51] Int. Cl.[5] ..... F25B 17/08

[52] U.S. Cl. ..... 62/480; 62/294; 62/457.9

[58] Field of Search ..... 62/457.9, 480, 294, 62/101, 106, 371

[56] References Cited

U.S. PATENT DOCUMENTS 4,694,659 9/1987 Shelton ..... 62/480

4,752,310 6/1988 Maier-Laxhuber et al. ..... 62/480

*Primary Examiner*—Albert J. Makay

*Assistant Examiner*—John Sollecito

*Attorney, Agent, or Firm*—Pollock, VandeSande & Priddy

[57] ABSTRACT

A portable cooler for cooling an article by utilizing the endothermic and exothermic phenomenon pertaining to a chemical reaction is disclosed, in which an adsorbent and a working medium are sealed in a reaction chamber defined between an inner wall and an outer wall, a working medium retaining member is disposed on the inner wall inside the reaction chamber for holding therein the working medium, the working medium retaining member being spaced from the adsorbent disposed on the outer wall, and a heater is held in contact with the adsorbent for regenerating the same, at least a part of said outer wall constituting a heat radiating portion.

13 Claims, 4 Drawing Sheets

PORTABLE COOLER USING CHEMICAL REACTION

BACKGROUND OF THE INVENTION

1. Field of the Invention

The present invention relates to a relatively compact portable cooler operative by utilizing the endothermic and exothermic phenomenon pertaining to a chemical reaction.

2. Description of the Prior Art

Various attempts have been made to realize a system which performs a cooling cycle, heating cycle, etc. by utilizing the endothermic and exothermic phenomenon pertaining to a chemical reaction. This system has the function of accumulating heat, cooling, carburetion and raising temperature and, therefore, is generally called as a chemical heat pump. One such known system is disclosed in Japanese Patent Laid-open Publication No. 59-104057, which comprises, as re-illustrated here in FIG. 4, two vacuum vessels 31, 33, an absorbent 32 disposed in the vessel 31 for reversibly absorbing and discharging a heat-transfer medium in the vapor phase, a fluid heat-transfer medium 34, a valve unit 36, and a connecting pipe 37 interconnecting the vessels 31, 32 and adapted to be opened and closed by the valve unit 36. In the operation of this system, the vessels 31, 33 are evacuated by a vacuum pump (not shown) and subsequently the valve unit 36 is opened whereupon the fluid heat-transfer medium 34 in the evacuated or vacuum vessel 33 evaporates. The heat-transfer medium 34 exits the vessel 33 in the vapor phase, then passes through the connecting pipe 37 and enters the evacuated vacuum vessel 31 where it reacts with the absorbent 31. In this instance, the vacuum vessel 33 extracts or absorbs heat from the ambient air by the evaporation of the fluid heat-transfer medium 34 and thereby lowers the temperature. The heat thus absorbed can be used for cooling purposes. On the other hand, the vacuum vessel 31 releases or liberates heat to the ambient air by the reaction between the heat-transfer medium 34 and the absorbent 32 and thereby raises the temperature. The heat thus liberated can be used for heating purposes. After the reaction completes, the vacuum vessel 31 is heated for regeneration, thereby restoring the entire system to the original state. Thus, the endothermic and exothermic phenomenon pertaining to a chemical reaction is used for the purpose of cooling, heating and the like. The chemical reaction used in the disclosed chemical heat pump is absorption, however, any other suitable reaction system such as addition, hydration, adsorption, etc. may be used in compliance with the intended purpose.

Various cooling/heating equipment using such chemical reactions have been proposed heretofore, however, most of them have not yet been put into practical use for some reasons. One reason is that the proposed cooling-/heating equipment are large in size and heavy in weight. As described above with reference to FIG. 4, the prior system includes, as essential components, two vessels, a passage interconnecting the vessels and a valve unit disposed in the passage. Each of the vessels further requires a heat-exchange means for promoting the reaction. In the case where the working medium comprises water, the inside of the system forms nearly a perfect vacuum because the vapor pressure of water around the room temperature is about several to several tens Torr. This means that the passage and the valve unit must have a large opening area so as to minimize pressure losses when the working medium passes through them in the vapor phase. The entire system having such passage and valve unit is large in size and expensive to manufacture.

SUMMARY OF THE INVENTION

With the foregoing drawbacks of the prior art in view, it is an object of the present invention to provide a cooler operative by utilizing the endothermic and exothermic phenomenon pertaining to a chemical reaction, which cooler is compact, portable, simple in construction and can be manufactured less costly.

A cooler of this invention comprises an inner wall defining a cooling chamber for receiving therein an article to be cooled and an outer wall defining jointly with the inner wall a reaction chamber for sealingly receiving therein an adsorbent and a working medium, the adsorbent being disposed on the outer wall. A working medium retaining member is disposed on the inner wall within the reaction chamber for holding therein the working medium, the working medium retaining member being spaced from the adsorbent. A heater is held in contact with the adsorbent for regenerating the adsorbent. A heat radiating portion constitutes at least a part of the outer wall for radiating heat from the outer wall to cool the adsorbent.

With this construction, the adsorbent and the working medium which are sealed together in the reaction chamber are reactive together to perform adsorption and desorption (regeneration) in the reaction chamber Since the distance of movement of the working medium (the distance between the position of condensation of the working medium and the position of adsorption of the working medium) is very small, the foregoing reaction takes place without the need for a connecting pipe or a valve provided for the passage of the working medium. The adsorbent is regenerated by the heater and substantially at the same time the working medium is condensed on the working medium retaining member disposed on the inner wall. During that time, the cooling chamber defined by the inner wall is filled with water. After regeneration of the adsorbent, the cooling chamber is emptied and an article to be cooled is sealed in the cooling chamber. The cooler is allowed to stand in the atmosphere while the sensible heat of the adsorbent and heat subsequently generated by adsorption of the working medium are being liberated from the heat radiating portion to the atmosphere. As the adsorbent is cooled, the adsorption begins whereupon the working medium retained on the working medium retaining portion evaporates progressively. By the evaporation of the working medium, heat is extracted from the inner wall, thereby lower the temperature of the cooling chamber and of the article received therein.

The heater for heating the adsorbent to regenerate the same may be an electric heater or a combustion heater using a fuel gas, a fuel oil or a solid fuel. In the case of the combustion heater, the heater is detachably connected to a body of the cooler (the outer wall, in particular). The cooler having such detachable heater is smaller in size and more handy to carry than the cooler having an integral heater, and hence is particularly suitable for camping or similar outdoor activities in which the electricity is not readily available.

The working medium preferably is water, alcohol or a mixture thereof. Such working medium has a large latent heat of vaporization which brings about a large cooling capacity per unit weight and thereby reduces the overall size of the cooler. Furthermore, since the vapor pressure of the working medium is small, the reaction chamber forms nearly a perfect vacuum. Consequently, the cooler solely constitutes a vacuum insulator without the need for a separate heat-insulating treatment.

The above and other objects, features and advantages of the present invention will become more apparent from the following description when making reference to the detailed description and the accompanying sheets of drawings in which preferred structural embodiments incorporating the principles of the present invention are shown by way of illustrative example.

DETAILED DESCRIPTION OF THE PREFERRED EMBODIMENTS

Figure 1:
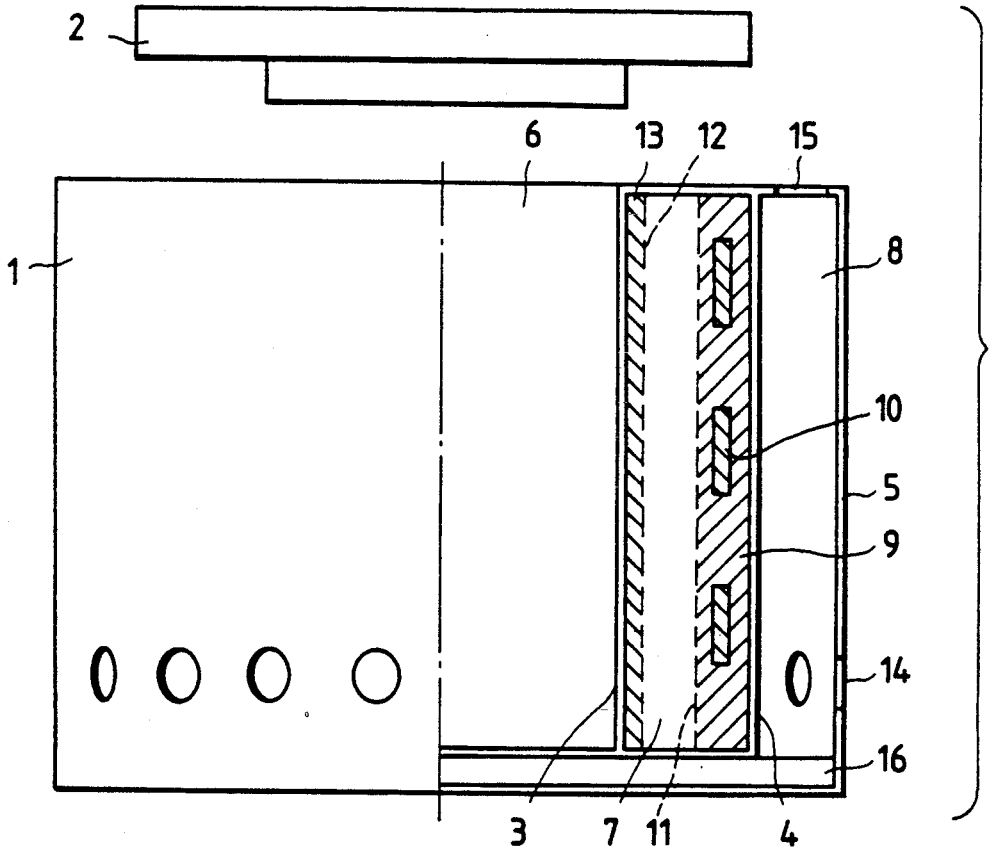
FIG. 1 is a schematic front elevational, partly cross-sectional view of a cooler according to a first embodiment of the present invention.

Referring now to the drawings, wherein the like reference characters designate like or corresponding parts throughout the several views, there is shown in FIG. 1 a cooler according to a first embodiment of this invention.

The cooler includes a bottomed hollow cylindrical body 1 having a cooling chamber 6 defined therein for receiving an article to be cooled, and a cover 2 for opening and closing an upper open end of the body 1. The cover 2 is made of an organic heat-insulating material. The body 1 includes an inner wall 3 defining the cooling chamber 6, and an outer wall 4 defining jointly with the inner wall 3 an annular reaction chamber 7 in which an adsorbent 9 and a working medium are sealingly received. In the illustrated embodiment, the adsorbent 9 is activated carbon, while the working medium is ethanol. The adsorbent may be zeolite or silica gel and the working medium may be water. Any other material may be selected in view of the intended use of the cooler. However, water, alcohol or a mixture thereof is a preferable working medium because it has a large latent heat of vaporization and thereby provides a large cooling capacity per unit weight which is particularly advantageous to the reduction of the overall size of the cooler. The vapor pressure of such working medium is small so that the reaction chamber 7 forms nearly a perfect vacuum. Consequently, the reaction chamber 7 solely constitutes a vacuum, heatinsulating device which obviates the need for a special heat-insulating treatment. In the case where alcohol is a main component of the working medium, the cooler can be used as a refrigerator.

The working medium which is received in the reaction chamber 7 is kept either in a first condition in which it is adsorbed on the adsorbent 9 or alternatively in a second condition in which it is held on a working medium retaining member 13 in the liquid phase. The working medium retaining member 13 is disposed on the inner wall 3 and spaced from the adsorbent 9. The working medium retaining member 13 is formed of a porous material such as a sintered metal fiber, fabric or the like which is capable of retaining or absorbing the working medium. The adsorbent 9 is supported by an adsorbent supporting wall 11 and held in contact with the outer wall 4. The adsorbent supporting wall 11 is formed of a highly air-permeable reticular material such as a wire net of stainless steel, a plastic net, etc. The adsorbent 9 is a porous solid material and hence is relatively resistant to heat transfer. To achieve a high rate of heat transfer relative to the adsorbent 9 it is preferable that a suitable heat transfer promoting material such as metal flakes is mixed with the adsorbent 9. As an alternative, radiating fins may be provided on the adsorbent 9.

A reflective insulation wall 12 is superposed on the working medium retaining member 13 and confronted with the adsorbent supporting wall 11 for blocking radiation heat emitted from the adsorbent 9 when it is heated in the regenerating cycle. Preferably, the reflective insulation wall 12 is made of an air-permeable, highly heat-reflective material, and in the illustrated embodiment, a punching metal of mirror-finished stainless steel is employed. Designated at 10 is an heater for heating the adsorbent 9 to regenerate the same. The heater 10 is embedded in the absorbent 9 which is composed of activated carbon. Since the activated carbon is electrically conductive, the heater 10 is comprised of a sheathed heater. The heater 10 is of the self-operated temperature control type. Instead of embedding in the adsorbent 9, the heater 10 may be disposed adjacent to the adsorbent 9. For instance, it is possible to place the heater 10 on the outside of the outer wall as long as an effective transfer of heat to the adsorbent 9 can be achieved.

The cooler body 1 further includes a peripheral wall 5 extending around the outer wall 4 so as to define therebetween an air-flow passage 8. The peripheral wall 5 has a plurality of circumferentially spaced air inlets 14 at a lower portion thereof, and a plurality of circumferentially spaced air outlets 15 at an upper portion thereof. Either the air inlets 14 or the air outlets 15 may have shutters (not shown) adapted to be closed during the regeneration cycle to lower heat losses caused by the convection of air, thereby improving the heating efficiency of the heater 10. A circular heat-insulating member 16 is disposed on the bottom of the cooler body 1 for thermally isolating the inside of the cooling chamber 6 from the outside ambient air.

The cooler of the foregoing construction operates as follows. Since the working medium which is received in the reaction chamber 7 together with the adsorbent 9, it is normally adsorbed in the adsorbent 9. Prior to the use of the cooler, the adsorbent 9 is regenerated. To this end, the cooling chamber 6 is filled with water and subsequently the electric heater 10 is energized. The adsorbent g is heated by the electric heater 10 whereupon the working medium is desorbed from the adsorbent 9 in the gaseous phase. Then, the thus-desorbed gaseous working medium is contacts the porous working medium retaining member 13. In this instance, the working medium retaining member 13 constitutes a low temperature portion in the reaction chamber 7 as it is held in contact with the inner wall 3 cooled by water received in the cooling chamber 6. The gaseous working medium is, therefore, condensed by the cooled working medium retaining member 13 and retained on the same in the liquid phase. At the same time, reaction chamber 7 supplies heat to the cooling chamber 6 by condensation of the working medium and thereby gradually increase the temperature of water received in the cooling chamber 6. The heating temperature of the adsorbent 9 which is needed for regeneration of the working medium depends on the reaction system used. In the illustrated embodiment, the adsorbent 9 is heated at about 100° C.

The regeneration cycle is followed by the cooling cycle. The heater 10 is de-energized to stop heating of the adsorbent 9. After the cooling chamber 6 is emptied, an article to be cooled is placed in the cooling chamber 6 and then the cover 2 is set on the cooler body 1 to close the cooling chamber 6. Thereafter, the cooler is allowed to stand for a while. During that time, since the outer wall 4 is still hot, air existing around the outer wall 4 is heated and reduced in density. Consequently, the air moves upward toward the air outlet 15 and thence is liberated from the air outlets 15. At the same time, fresh air flows from the air inlet 14 into the air-flow passage 8. Thus, the convection is created within the air-flow passage 8. In this instance, the outer wall 4 constitutes a heat radiating portion, so that the adsorbent 9 is gradually cooled. In order to improve the cooling efficiency, it is possible to provide heat radiating fins on the outside surface of the outer wall 4. Due to a temperature drop of the adsorbent 9, the equilibrium of adsorption changes whereupon absorption of the working medium on the adsorbent 9 begins. The working medium (i.e., ethanol in the illustrated embodiment, retained on the working medium retaining member 13 in the liquid phase) evaporates and moves radially outwardly across the reaction chamber 7 in the vapor phase and then is adsorbed on the adsorbent 9. The heat produced by adsorption of the working medium is radiated from the outer wall 4 to the air-flow passage 8 which in turn is liberated from the air outlets 15 to the outside of the cooler. At the same time, the inner wall 3 is cooled by evaporation of the working medium with the result that the article contained in the cooling chamber 6 is cooled. Since the upper and lower ends of the cooler body 1 are thermally insulated by the heat-insulating members 2, 16, and since the periphery of the cooler body 1 is vacuum insulated by the reaction chamber 7, a desired cooling effect can be maintained for a long time after the equilibrium of adsorption is reached. Although the cooler body 1 in the embodiment described above has a hollow cylindrical shape, it is possible to construct the cooler body 1 in the form of a rectangular hollow block or the like.

Figure 2:
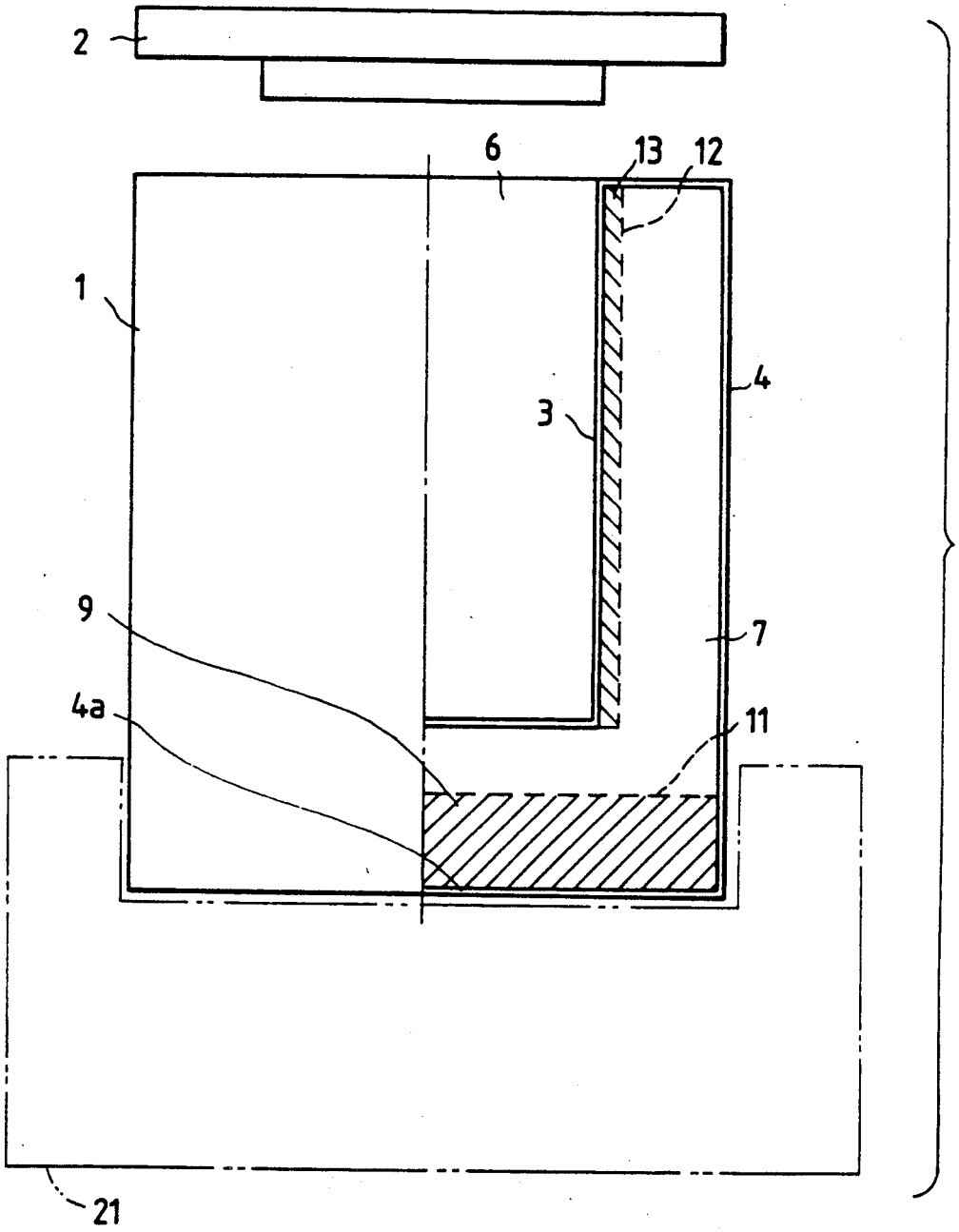
FIG. 2 is a schematic front elevational, partly cross-sectional view of a cooler according to a second embodiment of this invention.

FIG. 2 shows a cooler according to a second embodiment of this invention. The cooler of this embodiment differs from the cooler of the first embodiment shown in FIG. 1 in that the cooler body 1 has a double tubular construction and a reaction chamber 7 defined between inner and outer wall 3, 4 has a substantially U-shaped cross section. Further differences are in that an absorbent 9 is disposed on the bottom 4*a* of the outer wall 4 which is vertically spaced from the bottom of the inner wall 3, and in that a heater 21 is detachably connected to a body 1 of the cooler for regenerating the adsorbent 9. The heater 21 is an electric heater, or a combustion heater which utilizes a combustion heat of a fuel gas, a fuel oil or a solid fuel. A lower portion of the outer wall 4 including the bottom 4*a* constitutes a heat-receiving portion which receives heat from the heater 21 and transfers the heat to the adsorbent 9 in the regenerating cycle. During the regenerating cycle, the cooling chamber 6 is filled with water and the working medium moves in the same manner as done with the cooler of the foregoing embodiment shown in FIG. 1. The regenerating cycle is followed by a cooling cycle. After heating of the adsorbent 9 completes, the heater 21 is detached from the cooler body 1. Then, water in the cooling chamber 6 is discharged and subsequently the cooling chamber 6 is closed by the cover 2 with an article to be cooled is received in the cooling chamber 6. The cooler is allowed to stand for a while in the atmosphere. The entire area of the outer wall 4 including the bottom 4*a* thereof constitutes a heat radiating portion and thereby gradually cools the adsorbent 9. Substantially at the same time, the inner wall 3 of the cooler body 1 is cooled by evaporation of the working medium, which in turn lowers the temperature of the cooling chamber 6. To accelerate cooling of the cooling chamber 6, cool air may be forced by a fan against the outer wall 4 to cool the same. Alternatively, it is possible to cool the outer wall 4 by immersing the lower portion of the cooler body 1 into water.

Figure 3:
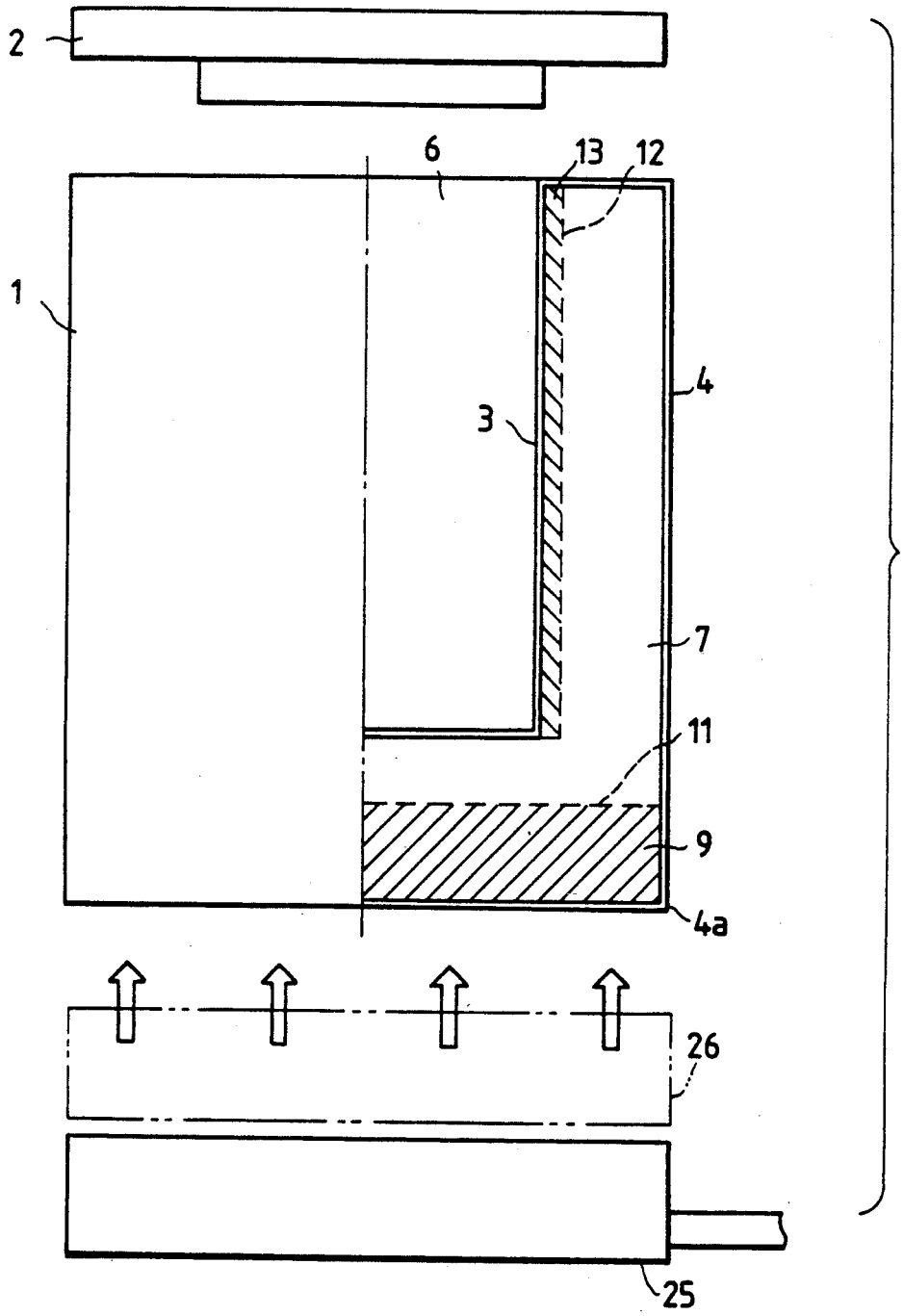
FIG. 3 is a schematic front elevational, partly cross-sectional view of a cooler according to a third embodiment of this invention.
Figure 4:
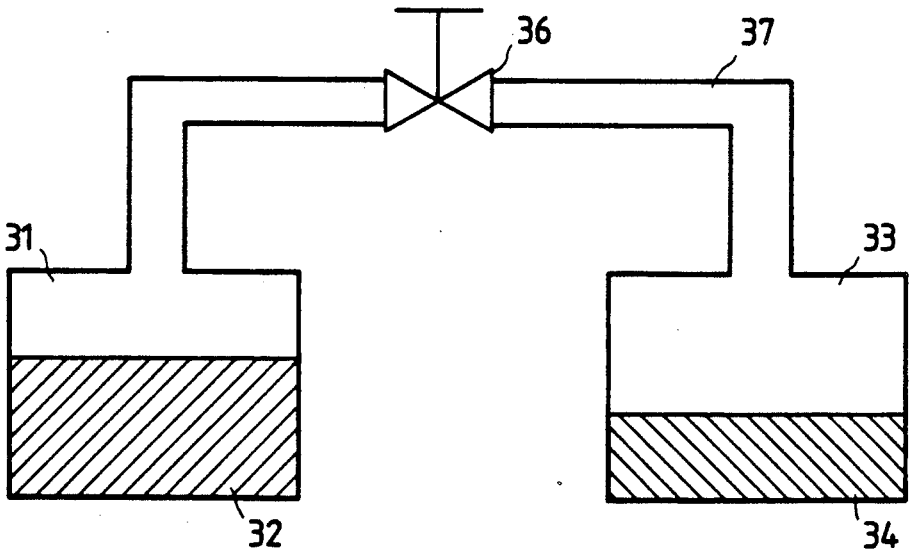
FIG. 4 PRIOR ART
FIG. 4 is a diagrammatical view showing the general construction of a conventional cooler.

A cooler shown in FIG. 3 is substantially the same as the cooler of FIG. 2 with the exception that a heater 25 comprises a portable gas stove. In FIG. 3, reference character 26 generally designates flames of burning gas and arrows indicate the direction of movement of a combustion heat. The gas combustion heater or stove 25 may be substituted by a combustion heater of any other type using a fuel oil, a solid fuel or the like as long as it gives off necessary heat for regeneration of the adsorbent 9. A lower portion of the outer wall 4 including the bottom 4 thereof constitutes a heat receiving portion when the adsorbent 9 is regenerated, while it constitutes a heat radiating portion when the working medium is adsorbed on the adsorbent 9. The coolers shown in FIGS. 2 and 3 are particularly suitable for camping or outdoor activities in which the electricity is not readily available.

In the embodiments described above, the chemical reaction used for cooling the heat chamber 6 is the adsorption. Similar reactions, such as hydration, addition and adsorption may be used, however, the adsorption is optimum because of its superior repeatability and reliability of reaction.

Obviously various minor changes and modifications of the present invention are possible in the light of the above teaching. It is therefore to be understood that within the scope of the appended claims the invention may be practiced otherwise than as specifically described.

What is claimed is:

1. A cooler comprising:

(a) an inner wall defining a cooling chamber for receiving therein an article to be cooled;

(b) an outer wall defining jointly with said inner wall a reaction chamber sealingly receiving therein an adsorbent and a working medium, said adsorbent being disposed on said outer wall;

(c) a working medium retaining member disposed on said inner wall within said reaction chamber for holding therein said working medium, said working medium retaining member being spaced from said adsorbent;

(d) a heater held in contact with said adsorbent; and (e) a heat radiating portion constituting at least a part of said outer wall.

2. A cooler according to claim 1, wherein said adsorbent is a material selected from the group consisting of activated carbon, zeolite and silica gel.

3. A cooler according to claim 1, wherein said working medium is a material selected from the group consisting of water, alcohol and a mixture thereof.

4. A cooler according to claim 1, wherein said working medium retaining member is made of a porous material.

5. A cooler according to claim 4, wherein said working medium retaining member is formed of a sintered metal fiber.

6. A cooler according to claim 4, wherein said working medium retaining member is formed of a fabric.

7. A cooler according to claim 1, further including an air-permeable adsorbent-supporting wall supporting thereon said adsorbent and facing toward said inner wall.

8. A cooler according to claim 7, wherein said adsorbent-supporting wall is a wire net of stainless steel.

9. A cooler according to claim 7, wherein said adsorbent-supporting wall is a plastic net.

10. A cooler according to claim 1, further including an air-permeable, heat-reflective insulating wall disposed on said working medium retaining member and facing to said outer wall.

11. A cooler according to claim 10, wherein said heat-reflective insulating wall is formed of a punching metal of mirror-finished stainless steel.

12. A cooler according to claim 1, wherein said adsorbent is electrically conductive, said heater comprising a sheathed heater embedded in said conductive adsorbent.

13. A cooler according to claim 1, further including a peripheral wall extending around said outer wall an defining jointly therewith an air-flow passage, said peripheral wall having at least one air inlet at one end thereof and at least one air outlet at the opposite end thereof.

* * * * *